US007665443B2

(12) United States Patent
Pensar et al.

(10) Patent No.: US 7,665,443 B2
(45) Date of Patent: Feb. 23, 2010

(54) CONTROL SYSTEM OF A FUEL INJECTION APPARATUS OF AN INTERNAL COMBUSTION ENGINE

(75) Inventors: Johan Pensar, Vaasa (FI); Jonas Akerman, Sundom (FI)

(73) Assignee: Wärtsilä Finland Oy, Vaasa (FI)

( * ) Notice: Subject to any disclaimer, the term of this patent is extended or adjusted under 35 U.S.C. 154(b) by 294 days.

(21) Appl. No.: 11/912,708

(22) PCT Filed: Mar. 22, 2006

(86) PCT No.: PCT/FI2006/050108

§ 371 (c)(1),
(2), (4) Date: Oct. 26, 2007

(87) PCT Pub. No.: WO2006/114476

PCT Pub. Date: Nov. 2, 2006

(65) Prior Publication Data

US 2009/0293846 A1 Dec. 3, 2009

(30) Foreign Application Priority Data

Apr. 28, 2005 (FI) ..... 20055199

(51) Int. Cl.
*F02M 51/00* (2006.01)

(52) U.S. Cl. ..... 123/479; 123/490; 239/585.1

(58) Field of Classification Search ..... 123/472, 123/478, 479, 490; 239/585.1, 585.2
See application file for complete search history.

(56) References Cited

U.S. PATENT DOCUMENTS 4,356,976 A * 11/1982 Eblen et al. ..... 239/533.5
4,955,347 A * 9/1990 Toyoda ..... 123/472
5,497,751 A * 3/1996 Ohtake ..... 123/479
5,884,896 A 3/1999 Kono et al.
6,113,014 A * 9/2000 Coldren et al. ..... 239/585.1
6,422,199 B1 * 7/2002 Buckley et al. ..... 123/299
6,796,511 B2 * 9/2004 Hohl ..... 239/5
6,877,679 B2 * 4/2005 Lawes ..... 239/585.1
7,422,165 B2 * 9/2008 Cernoia et al. ..... 239/585.1
2001/0022163 A1 9/2001 Cosfeld et al.
2002/0170986 A1 11/2002 Rieger et al.
2004/0050977 A1 * 3/2004 Rieger et al. ..... 239/585.1

FOREIGN PATENT DOCUMENTS

| | | |
|---|---|---|
| EP | 0631046 | 12/1994 |
| JP | 7259688 | 10/1995 |
| KR | 2002096699 A * | 12/2002 |
| WO | 8100283 | 2/1981 |

* cited by examiner

*Primary Examiner*—Stephen K Cronin
*Assistant Examiner*—David Hamaoui
(74) *Attorney, Agent, or Firm*—Chernoff, Vilhauer, McClung & Stenzel, LLP

(57) ABSTRACT

A control arrangement for a fuel injection apparatus of an internal combustion engine, the fuel injection apparatus comprising at lest two fuel injector nozzles, the injection action of which is controllable via a solenoid, and at least two control units arranged to control the solenoids controlling the injection action. According to the invention, each injector nozzle is provided with a first and second solenoid and the first and second solenoid are in connection with a different control unit.

11 Claims, 1 Drawing Sheet

CONTROL SYSTEM OF A FUEL INJECTION APPARATUS OF AN INTERNAL COMBUSTION ENGINE

Figure 1:
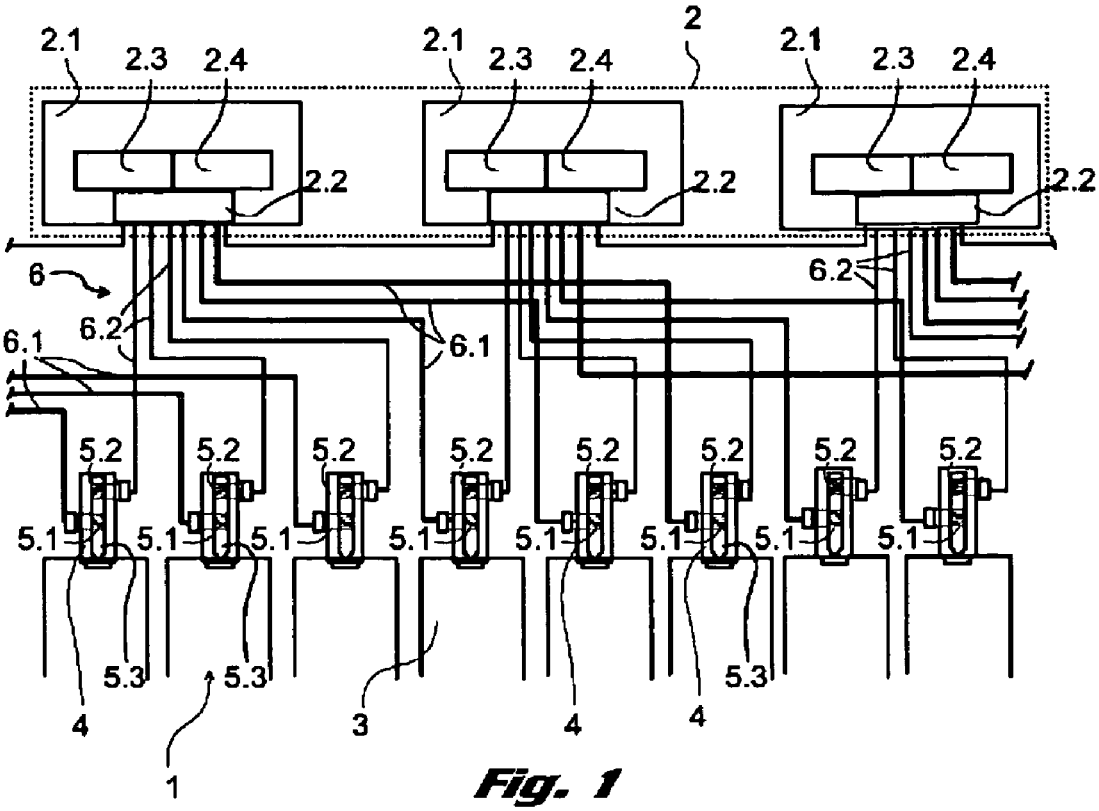

This is a national stage application filed under 35 USC 371 based on International Application No. PCT/FI2006/050108 filed Mar. 22, 2006, and claims priority under 35 USC 119 of Finnish Patent Application No. 20055199 filed Apr. 28, 2005.

The present invention relates to a control arrangement of a fuel injection apparatus of an internal combustion engine as described in the preamble of claim 1, the system comprising at least two fuel injector nozzles, the injection action of which is controllable via a solenoid, and at least two control units arranged to control the solenoids controlling the injection action.

The invention also relates to a method of controlling the fuel injection system of an internal combustion engine as described in the preamble of claim 5, the fuel injection apparatus comprising at least two fuel injector nozzles, the injection action of which is controlled by means of a solenoid, and at least two control units controlling the solenoids controlling the injection action of the fuel injector nozzles.

Strict reliability requirements are placed on especially power plant and marine engines. In order to improve efficiency and to reduce exhaust gas emissions use of electronically controlled fuel injection apparatuses has become more common. Such injection apparatuses, however, cause a risk of decreased reliability. Typically, the reliability of apparatuses has been improved by doubling or even tripling actuators and metering devices. In such solutions the parallel apparatuses are typically electrically connected in parallel, whereby failure of one apparatus can, however, due to the parallel connection prevent the actual operation by causing interference with the parallel, intact apparatus. The failed apparatus can, for example, ground the signal conductor, whereby the system no longer operates. Further, in multiple systems the risk of failures increases due simply to the increase in the amount of the apparatuses.

The object of the invention is to provide a control system for a fuel injection system of an internal combustion engine, the system being reliable in operation and achieving a high operation reliability.

The aims of the invention are mainly achieved as disclosed in the appended claims 1 and 5 and more closely disclosed in other claims. The control arrangement of a fuel injection apparatus according to the invention comprises at least two fuel injector nozzles, the injection action of which is controllable by means of a solenoid, and at least two control units arranged to control the solenoid controlling the injection action of the injector nozzles. A characterizing feature of the invention is that each injector nozzle is provided with a first and second solenoid and that the first and second solenoid are in connection with a different control unit. The first and second solenoid are in connection with a same, shared core, galvanically separated from each other, i.e. electrically independent from each other.

Driving one of the solenoids of the solenoid pair is sufficient for moving the core of the solenoid. Thus, in a normal situation the solenoid not being used for moving the core acts as a control solenoid. This means that the movement of the core caused by the drive of the first solenoid induces an electrical current in the second solenoid, the current being monitored by the control unit. In case the controlling detects immobility of the core the control of the operation of the injector nozzles is moved to take place by means of the second solenoid. Thus, the operation of the engine is normalized after only one non-occurrence of the core movement as the operation of the second solenoid replaces the failed first solenoid.

According to the invention, the control connection of the solenoids and control units is arranged so that a number of first connection lines and second connection lines are in connection with each control unit, the first connection lines being in connection with the first pairs of solenoids of the first solenoids and the second connection lines are in connection with the different second solenoids of the second solenoid pairs. By means of such an arrangement a failure can be avoided even should a control unit for some reason become inoperative.

In an arrangement according to the invention each control unit comprises a communication module, a control module and a diagnostics module. The communication module is arranged to form data communication for each connection line either between the control module or the diagnostics module. In a normal situation the first solenoid of the injector nozzle is in connection with the control module of the first control unit, whereby the control module is arranged to control the operation of the first solenoid and the second solenoid is in connection with the diagnostics module of the second control unit, whereby the diagnostics module is arranged to analyse the operation of the second solenoid and thereby the operation of the injector nozzle.

In a method according to the invention for controlling the operation of the fuel injection system of an internal combustion engine, the fuel injection system comprising at least two fuel injector nozzles, the injection action of which is controlled by means of a solenoid, and at least two control units controlling the solenoid controlling the injection action of the injector nozzles, a first and a second solenoid being used for the operation of each injector nozzle and the operation of the first and second nozzles being controlled by different control units. In a normal situation the first solenoid drives the operation of the injector nozzle and the second solenoids monitors the operation of the injector nozzle. In case the monitoring of the second solenoid detects a malfunction in the operation of the injector nozzle, the second solenoid is changed to drive the operation of the injector nozzle.

By means of the invention the possibility of malfunctions in the running of the engine is very effectively minimized.

In the following the invention is described by means of example with reference to the appended schematic drawing, in which FIG. 1 illustrates an embodiment of a fuel injection arrangement of an internal combustion engine.

FIG. 1 schematically illustrates a fuel injection apparatus 1 of an internal combustion engine and its control arrangement 2. Here, the control arrangement 2 consists of a number of control units 2.1 that in practice can be physically integrated into a common unit, which is shown with a dotted line. The fuel injection apparatus comprises injector nozzles 4 being in connection with the cylinders 3 of the engine. The operation of the injector nozzles and thus the injection action is controlled by means of a first and second solenoid 5.1, 5.2. In the embodiment shown in FIG. 1 the solenoids are arranged to directly control at the pin 5.3 of the needle, but the basic idea of the invention can be applied to, for example, control the releasing of control pressure of the hydraulic fluid in hydraulically controlled injector nozzles, which in hydraulically controlled systems causes the opening of the needle of the injector nozzle.

Each injector nozzle is provided with a pair of solenoids 5.1, 5.2, the first 5.1 and second 5.2 solenoid of which pair are arranged in connection with a core, i.e. pin 5.3 shared by them. It is obvious that the structure of the injector can in practice change, but it is essential that the movement of the pin has an effect on the movement of the injector needle itself. The control units are in control communication with the solenoids via connection lines 6 or the like.

The connection lines 6 are formed by a number of first connection lines 6.1 and a number of second connection lines 6.2. The cables are used so that first connection lines 6.1 connect the first solenoid 5.1 of each injector nozzle to the control unit 2.1 and the second connection lines 6.2 connect the second solenoid 5.2 of each injector nozzle with the control unit 2.1 and further so that the solenoids of the solenoid pair 5.1, 5.2 of the same injector nozzle are in connection to a different control unit.

Both solenoids of each injector nozzle are dimensioned and/or chosen so that each can alone accomplish the movement of the pin, whereby in normal situation one of the solenoids can be used for diagnostics purposes. In practice this means that in normal situation the fuel injection arrangement and thus also the engine can be kept in operation by means of the first solenoid 5.1 of the pair of solenoids. Thus, the second solenoid 5.2 of the pair of solenoids is used for monitoring the operation of the first solenoid 5.1. Further, preferably the first and second solenoid of each pair of solenoids are in connection to a different control unit 2.1. In a normal situation the control unit in connection with the second unit is arranged to operate in diagnostics mode in relation to this solenoid. As the first solenoid causes the movement of the pin, i.e. beginning of the injection action, this can be detected in the circuit of the second solenoid, which is detected by the second control unit being in diagnostics mode.

Each control unit comprises a communications module 2.2 controlling the connection of the connecting lines 6 to the other modules of the control unit. In addition to the communications module 2.2 the control unit comprises at least a control module 2.3 and a diagnostics module 2.4. According to the invention the communications module 2.2 has information about which of the solenoids 5.1, 5.2 of the injector nozzle drive the injection action and which are used for diagnostics. The communications module 2.2 uses this data for creating a communication connection for each connection line 6 with either the control or diagnostics module. Thus, in practice the second solenoid 5.2 provides the diagnostics module 2.4 of control unit information about the operation of the injector nozzle via the communications module 2.2 and/or controlled by it. As the diagnostics module 2.4 detects that the pin 5.3 of the injector nozzle is not moving, i.e. there for some reason is a failure in the operation of the first solenoid, an operation is performed on the basis of this data for taking the second solenoid 5.2 of the injector nozzle into use in driving the injection action. In this operation the communications module 2.4 of the control unit 2.1 in connection with the second solenoid 5.2 directs the connection to the control module 2.3 instead of the diagnostics module 2.4, whereby the control module 2.3 uses the second solenoid 2.4 for driving the injection action. Even if the failure causing the inoperability of the first solenoid had happened in the control module of the control unit, the engine still runs without malfunctions, because the pairs of solenoids 5.1, 5.2 are in connection with different control units.

The invention is not limited to the embodiments described here, but a number of modifications thereof can be conceived of within the scope of the appended claims.

The invention claimed is:

1. A fuel injection apparatus for an internal combustion engine, the fuel injection apparatus comprising:

at least first and second fuel injector nozzles each provided with first and second solenoids, wherein injection action of each injector nozzle is controllable selectively either by the first solenoid or the second solenoid, and at least first and second control units each connected to at least two solenoids for controlling the injection action of the fuel injector nozzles, and wherein the first and second solenoids of the first injector nozzle are connected to different respective control units and the first and second solenoids of the second injector nozzle are connected to different respective control units.

2. A fuel injection apparatus according to claim 1, comprising a plurality of first connection lines and a plurality of second connection lines connected to the first control unit, and a plurality of first connection lines and a plurality of second connection lines connected to the second control unit, and wherein the first connection lines are connected to the first solenoids and the second connection lines are connected to the second solenoids.

3. A fuel injection apparatus according to claim 2, wherein the first control unit comprises a communications module, a control module, and a diagnostics module, and the communications module connects each of said first connection lines to either the control module or the diagnostics module.

4. A fuel injection apparatus according to claim 3, wherein the communications module of the first control unit connects the first connection lines to the control module of the first control unit, whereby the control module controls the injection action of a plurality of injectors, and the communications module of the first control unit connects the second connection lines to the diagnostics module of the first control unit, whereby the diagnostics module analyses operation of the second solenoids of a plurality of injectors.

5. A fuel injection apparatus for an internal combustion engine, the fuel injection apparatus comprising:

first, second, third and fourth fuel injector nozzles each provided with first and second solenoids, wherein injection action of each injector nozzle is controllable selectively either by the first solenoid or the second solenoid, and a first control unit connected to a solenoid of each of said first, second, third and fourth fuel injector nozzles, a second control unit connected to a solenoid of each of said first, second, third and fourth fuel injector nozzles, wherein the first and second solenoids of the first injector nozzle are connected to different respective control units, the first and second solenoids of the second injector nozzle are connected to different respective control units, the first and second solenoids of the third injector nozzle are connected to different respective control units, and the first and second solenoids of the fourth injector nozzle are connected to different respective control units, whereby the first and second control units control the injection action of the first, second, third and fourth fuel injector nozzles.

6. A fuel injection apparatus according to claim 5, comprising a two first connection lines and two second connection lines connected to the first control unit, and two first connection lines and two second connection lines connected to the second control unit, and wherein the four first connection lines are connected to the four first solenoids respectively and the four second connection lines are connected to the four second solenoids respectively.

7. A fuel injection apparatus according to claim 6, wherein the each control unit comprises a communications module, a control module, and a diagnostics module, and the communications module of each control unit connects each of the connection lines that are connected to the control unit to either the control module or the diagnostics module of the control unit.

8. A fuel injection apparatus according to claim 7, wherein the communications module of the first control unit connects the two first connection lines that are connected to the first control unit to the control module of the first control unit, whereby the control module controls the injection action of two injectors, and the communications module of the first control unit connects the two second connection lines that are connected to the first control module to the diagnostics module of the first control unit, whereby the diagnostics module analyses operation of the second solenoids of two injectors.

9. A method of operating a fuel injection apparatus for an internal combustion engine, the fuel injection apparatus including at least first and second fuel injector nozzles, and the method comprising:

selectively employing a first or a second solenoid associated with the first fuel injector nozzle to control injection action of the first injector nozzle, selectively employing a first or a second solenoid associated with the second fuel injector nozzle to control injection action of the second injector nozzle, controlling the first and second solenoids associated with the first injector nozzle using different respective control units, and controlling the first and second solenoids associated with the second injector nozzle using different respective control units.

10. A method according to claim 9, comprising controlling injection action of each fuel injector nozzle by means of the first solenoid of the nozzle and employing the second solenoid of each fuel injector nozzle to monitor operation of the nozzle.

11. A method according to claim 9, comprising:

initially employing the first solenoid of a fuel injector nozzle to control injection action of the nozzle and employing the second solenoid of each fuel injector nozzle to monitor operation of the nozzle, and in the event that the second solenoid detects a malfunction in operation of the nozzle, subsequently employing the second solenoid to control injection action of the nozzle.

* * * * *